US008727343B2

(12) United States Patent
Sakamoto

(10) Patent No.: US 8,727,343 B2
(45) Date of Patent: May 20, 2014

(54) MEDIA CONTAINER AND IMAGE FORMING APPARATUS

(71) Applicant: Fuji Xerox Co., Ltd., Tokyo (JP)

(72) Inventor: Toyohide Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/714,513

(22) Filed: Dec. 14, 2012

(65) Prior Publication Data

US 2013/0320613 A1 Dec. 5, 2013

(30) Foreign Application Priority Data

May 30, 2012 (JP) ..... 2012-122593

(51) Int. Cl.
*B65H 1/00* (2006.01)

(52) U.S. Cl.
USPC ..... 271/171; 271/145; 271/96

(58) Field of Classification Search
USPC ..... 271/171, 11–13, 90–98, 145, 221, 223
See application file for complete search history.

(56) References Cited

U.S. PATENT DOCUMENTS

| | | | | |
|---|---|---|---|---|
| 6,015,144 | A | 1/2000 | Yoshii et al. | |
| 8,074,978 | B2 * | 12/2011 | Takahashi | 271/97 |
| 2002/0101027 | A1 * | 8/2002 | Koster et al. | 271/106 |

FOREIGN PATENT DOCUMENTS

| | | | |
|---|---|---|---|
| JP | 11-005643 A | | 1/1999 |
| JP | 2005-75472 | * | 3/2005 |
| JP | 2008-308326 | * | 12/2008 |
| JP | 2009-132470 | * | 6/2009 |
| JP | 2010-173801 | * | 8/2010 |

OTHER PUBLICATIONS

Machine translation of JP 2009-132470.*
Machine translation of Detailed Description section of JP 2008-308326.*
Machine translation of Detailed Description section of JP 2005-75472.*

* cited by examiner

*Primary Examiner* — Thomas Morrison
(74) *Attorney, Agent, or Firm* — Sughrue Mion, PLLC

(57) ABSTRACT

A media container includes a holding portion having a holding surface on which media are held; a jogger that comes into contact with edges of the media held on the holding surface to align the edges of the media, the jogger having a blower nozzle from which gas is ejected at the edges of the media held on the holding surface; a guided member that is supported by the jogger member and is supported by the holding portion so as to be movable toward and away from the edges of the media; a blowing device that is supported by the holding portion and ejects the gas at the media; and a flow path that is formed inside the guided member and connects the blowing device and the blower nozzle, through which the gas from the blowing device flows.

9 Claims, 7 Drawing Sheets

MEDIA CONTAINER AND IMAGE FORMING APPARATUS

CROSS-REFERENCE TO RELATED APPLICATIONS

This application is based on and claims priority under 35 USC 119 from Japanese Patent Application No. 2012-122593 filed May 30, 2012.

BACKGROUND

Technical Field

The present invention relates to a media container and an image forming apparatus.

SUMMARY

According to an aspect of the invention, there is provided a media container including a holding portion having a holding surface on which media are held; a jogger that comes into contact with edges of the media held on the holding surface to align the edges of the media, the jogger having a blower nozzle from which gas is ejected at the edges of the media held on the holding surface; a guided member that is supported by the jogger member and is supported by the holding portion so as to be movable toward and away from the edges of the media; a blowing device that is supported by the holding portion and ejects the gas at the media; and a flow path that is formed inside the guided member and connects the blowing device and the blower nozzle, through which the gas from the blowing device flows.

BRIEF DESCRIPTION OF THE DRAWINGS

Exemplary embodiments of the present invention will be described in detail based on the following figures, wherein:

FIGS. 2A and 2B are explanatory diagrams of a manual paper-feed tray according to the first example, in which FIG. 2A is a perspective view, and FIG. 2B is a partial sectional view of FIG. 2A;

DETAILED DESCRIPTION

Figure 1:
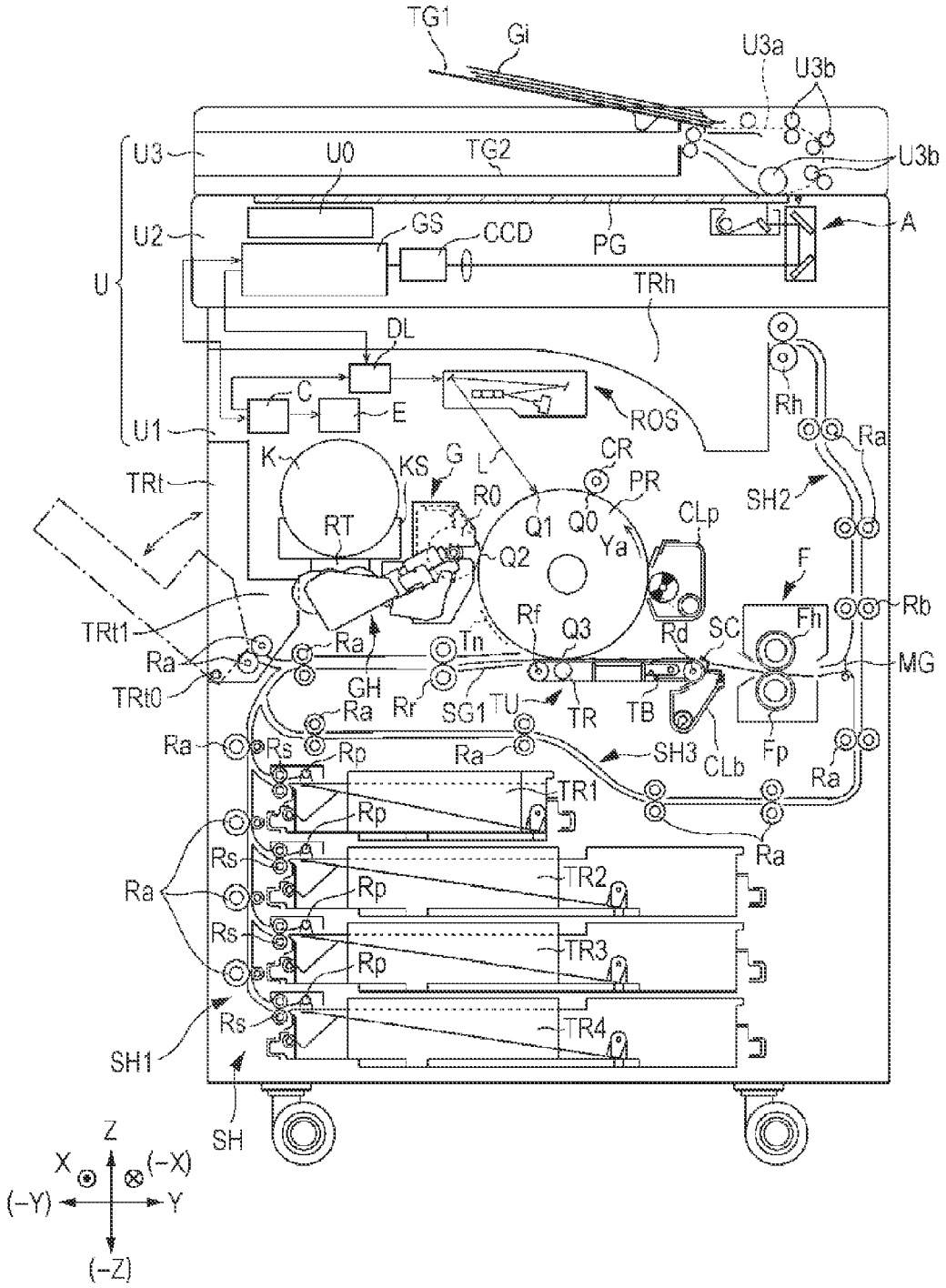
FIG. 1 is an explanatory diagram of an image forming apparatus including a media container according to a first example of the present invention.

Examples of exemplary embodiments of the present invention will be described below with reference to the drawings, but the present invention is not limited to those examples. For the ease of understanding the descriptions below, in the drawings, the X-axis, Y-axis, and Z-axis directions correspond to the front-rear, left-right, and top-bottom directions, respectively; and the directions indicated by the arrows X, −X, Y, −Y, Z, and −Z correspond to the forward, backward, rightward, leftward, upward, and downward directions, or the front, rear, right, left, upper, and lower sides. Furthermore, in the drawings, a symbol formed of a circle (○) and a dot (•) inside the circle represents an arrow directed from the back surface to the front surface of the sheet, and a symbol formed of a circle and a cross (ⓧ) represents an arrow directed from the front surface to the back surface of the sheet. For the ease of understanding, in the drawings, illustration of components other than those that have to be mentioned may be omitted.

First Example

FIG. 1 is an explanatory diagram of an image forming apparatus including a media container according to a first example of the present invention. In FIG. 1, a copying machine U, which is an example of the image forming apparatus according to the first example, includes a printer unit U1, which is an example of a recording unit and an example of an image recording device. The printer unit U1 supports a scanner unit U2 disposed thereon, which is an example of a reading unit and an example of an image reading device. The scanner unit U2 supports an auto feeder U3 disposed thereon, which is an example of a document transport device. The scanner unit U2 according to the first example supports a user interface U0, which is an example of an input portion. A user operates the copying machine U by inputting instructions via the user interface U0.

A document tray TG1, which is an example of the media container, is disposed on the auto feeder U3. The document tray TG1 holds a stack of documents, Gi, to be copied. A document output tray TG2, which is an example of a document output portion, is disposed below the document tray TG1. Document transport rollers U3*b* are disposed along a document transport path U3*a* extending between the document tray TG1 and the document output tray TG2.

A platen glass PG, which is an example of a transparent document stage, is provided in the top surface of the scanner unit U2. The scanner unit U2 according to the first example has a reading optical system A disposed below the platen glass PG. The reading optical system A according to the first example is supported so as to be movable in the left-right direction along the lower surface of the platen glass PG. Normally, the reading optical system A is located at the position shown in FIG. 1, which is the initial position. An imaging device CCD, which is an example of an imaging member, is disposed on the left side of the reading optical system A. An image processing unit GS is electrically connected to the imaging device CCD. The image processing unit GS is electrically connected to a writing circuit DL of the printer unit U1. The writing circuit DL is electrically connected to an exposure device ROS, which is an example of a latent-image forming device.

A photoconductor drum PR, which is an example of an image bearing member, is disposed below the exposure device ROS. The photoconductor drum PR rotates in the direction indicated by an arrow Ya. The photoconductor drum PR faces a charging roller CR, which is an example of a charger, in a charging area Q0. A charging voltage from a power supply circuit E is applied to the charging roller CR. The power supply circuit E is controlled by a controller C, which is an example of a controller. The controller C also performs various controlling tasks by transmitting and receiving signals to and from the image processing unit GS, the writing circuit DL, and the like. The exposure device ROS radiates a laser beam L, which is an example of writing light, to the surface of the photoconductor drum PR in a writing area Q1 located on the downstream side of the charging area Q0 with respect to the rotation direction of the photoconductor drum PR. A developing device G faces the surface of the photoconductor drum PR in a developing area Q2 located on the downstream side of the writing area Q1 with respect to the rotation direction of the photoconductor drum PR.

A cartridge K, which is an example of a developer container, is disposed on the left side of the developing device G. The cartridge K is removably attached to a cartridge holder KS, which is an example of a container support member. A reserve tank RT, which is an example of a temporary developer reservoir, is disposed below the cartridge holder KS. The reserve tank RT and the developing device G are connected by a developer transport device GH. A transfer area Q3 is located on the downstream side of the developing area Q2 with respect to the rotation direction of the photoconductor drum PR.

Paper-feed trays TR1 to TR4, which are examples of the media container, are removably supported at the lower side of the printer unit U1. The paper-feed trays TR1 to TR4 accommodate sheets S, which are examples of media. Pick-up rollers Rp, which are examples of media pick-up members, are disposed on the upper left side of the paper-feed trays TR1 to TR4. Separation rollers Rs, which are examples of separation members, are disposed on the left side of the pick-up rollers Rp. A media transport path SH1 extending upward is formed on the left side of the paper-feed trays TR1 to TR4. Multiple transport rollers Ra, which are examples of media transport members, are disposed along the transport path SH1. Register rollers Rr, which are examples of delivery members, are disposed in the transport path SH1, at a position on the downstream side with respect to the sheet transport direction and on the upstream side of the transfer area Q3.

A manual paper-feed tray TRt, which is an example of the media container and serves as a manual feed portion, is disposed on the left side of the cartridge holder KS. The manual paper-feed tray TRt according to the first example is supported so as to be rotatable about the center of rotation TRt0. Thus, the manual paper-feed tray TRt is movable between a stored position indicated by the solid line in FIG. 1 and a position where paper feeding is possible, indicated by the one-dot chain line in FIG. 1. When the manual paper-feed tray TRt according to the first example is in a stored position, a portion, TRt1, of the manual paper-feed tray TRt is located below the cartridge holder KS and on the left side of the reserve tank RT. Therefore, the overall volume and size of the copying machine U are reduced.

A transfer unit TU, which is an example of a transfer device and an example of a media transport device, is disposed in the transfer area Q3, below the photoconductor drum PR. The transfer unit TU includes an endless transfer belt TB, which is an example of the media transport members. The transfer belt TB is supported by a driving roller Rd, which is an example of a driving member, and a driven roller Rf, which is an example of a driven member, so as to be able to run around the rollers. A transfer roller TR, which is an example of a transfer member, is supported inside the transfer belt TB. The transfer roller TR faces the photoconductor drum PR with the transfer belt TB therebetween. Thus, the transfer area Q3 is formed by an area where the transfer roller TR and the photoconductor drum PR face each other. The power supply circuit E supplies a transfer voltage to the transfer roller TR.

A separating claw SC, which is an example of a media separating member, is disposed at the right end of the transfer belt TB. A belt cleaner CLb, which is an example of a transfer device cleaner, is disposed below the separating claw SC, such that it faces the surface of the transfer belt TB. A drum cleaner CLp, which is an example of an image bearing member cleaner, is disposed on the downstream side of the transfer area Q3 with respect to the rotation direction of the photoconductor drum PR, such that it faces the surface of the photoconductor drum PR.

A fixing device F is disposed on the right side of the transfer unit TU. The fixing device F includes a heating roller Fh, which is an example of a heating rotary member, and a pressing roller Fp, which is an example of a pressing rotary member. An output path SH2 extending upward, which is an example of the media transport path, is connected to the right side of the fixing device F. Transport rollers Rb and output rollers Rh capable of transporting media and rotatable in two directions, which are examples of the media transport members, are provided in the output path SH2. A paper output tray TRh, which is an example of a media output portion, is formed at the top surface of the printer unit U1.

A reversing path SH3, which is an example of the media transport path, is formed below the output path SH2. The reversing path SH3 according to the first example branches off from the output path SH2 downward and joins the transport path SH1 on the upstream side of the register rollers Rr in the sheet transport direction. A gate MG, which is an example of a transport-direction switching member, is disposed at a position where the reversing path SH3 branches off from the output path SH2. The gate MG according to the first example is formed of a deformable thin elastic sheet called a film. When a sheet S transported from the fixing device F passes through the gate MG, the gate MG is pushed and elastically deformed by the sheet S, allowing the sheet S to move to the output path SH2. Then, when the sheet S is transported from the output path SH2 to the reversing path SH3, the gate MG is maintained in an elastically restored state, preventing the sheet S from moving toward the fixing device F and guiding the sheet S toward the reversing path SH3.

Image Forming Operation

Multiple documents Gi stored in the document tray TG1 successively pass through a document reading position on the platen glass PG and are output on the document output tray TG2. When copying is performed by using the auto feeder U3, which automatically transports the documents, the reading optical system A, while staying at the initial position, exposes the documents Gi successively passing through the reading position on the platen glass PG. When copying is performed by an operator manually placing the documents Gi on the platen glass PG, the reading optical system A exposes and scans the document on the platen glass PG while moving in the left-right direction. The light reflected from the documents Gi passes through the optical system A and is focused on the imaging device CCD. The imaging device CCD converts the light reflected from the document and focused on the imaging surface into an electric signal.

The image processing unit GS converts a reading signal inputted from the imaging device CCD into a digital image signal and outputs to the writing circuit DL of the printer unit U1. The writing circuit DL outputs a control signal corresponding to an inputted image writing signal to the exposure device ROS. The surface of the photoconductor drum PR is charged by the charging roller CR in the charging area Q0. The laser beam L emitted from the exposure device ROS at the latent image writing position Q1 forms an electrostatic latent image on the surface of the photoconductor drum PR. In the developing area Q2, the developing device G develops the electrostatic latent image on the photoconductor drum PR passing through the developing area Q2 into a toner image Tn, which is an example of a visible image. When the developing device G consumes the developer, according to the amount consumed, the developer transport device GH is activated and supplies the developer from the cartridge K to the developing device G.

The sheets S in the trays TR1 to TR4 are taken out by the pick-up rollers Rp at preliminarily determined paper-feed timing. When multiple sheets S are picked up in a stacked state by the pick-up rollers Rp, the sheets S are separated into single sheets S by the separation rollers Rs. The sheet S that has passed through the separation rollers Rs is transported to the register rollers Rr by the transport rollers Ra. The sheet S fed from the manual paper-feed tray TRt also enters the transport path SH and is transported to the register rollers Rr.

The sheet S transported to the register rollers Rr is transported from a pre-transfer sheet guide SG1, which is an example of a pre-transfer guide member, to the transfer area Q3, in accordance with the time when the toner image on the surface of the photoconductor drum PR is moved to the transfer area Q3. The sheet S transported from the register rollers Rr is supported on the surface of the transfer belt TB and passes through the transfer area Q3. The toner image Tn on the surface of the photoconductor drum PR is transferred to the sheet S passing through the transfer area Q3 by the transfer voltage applied to the transfer roller TR. The residual toner on the surface of the photoconductor drum PR after passing through the transfer area Q3 is removed and cleaned by the drum cleaner CLp. The surface of the photoconductor drum PR after cleaning is charged again by the charging roller CR.

The sheet S to which the toner image Tn is transferred is separated from the transfer belt TB by the separating claw SC. The belt cleaner CLb removes developer, paper dust, etc. attached to the surface of the transfer belt TB, after the sheet S is separated from the transfer belt TB. When the sheet S separated from the transfer belt TB passes through a contact area between the heating roller Fh and the pressing roller Fp, the toner image is heated, pressed, and fixed. The recording sheet S to which the toner image is fixed passes through the gate MG by elastically deforming the gate MG and is transported to the output path SH2. The sheet S is transported by the transport rollers Rb and is output on the paper output tray TRh by the output rollers Rh.

When two-sided printing is performed, the sheet S on a first side of which an image is printed is transported to the downstream side by the transport rollers Rb and the output rollers Rh until the trailing end thereof has passed through the gate GT. Once the trailing end of the sheet S has passed through the gate GT1, the rotation direction of transport rollers Rb and the output rollers Rh is reversed to transport the sheet S from the output path SH2 to the reversing path SH3. In other words, the transport direction of the sheet S is reversed, i.e., the sheet S is switched back. The sheet S after being switched back is guided by the gate GT and is transported along the reversing path SH3. The sheet S transported along the reversing path SH3 enters the transport path SH1 and is transported to the register rollers Rr in a reversed state. Then, an image is printed on a second side of the sheet S in the transfer area Q3.

Manual Paper-Feed Tray

Figure 2A:
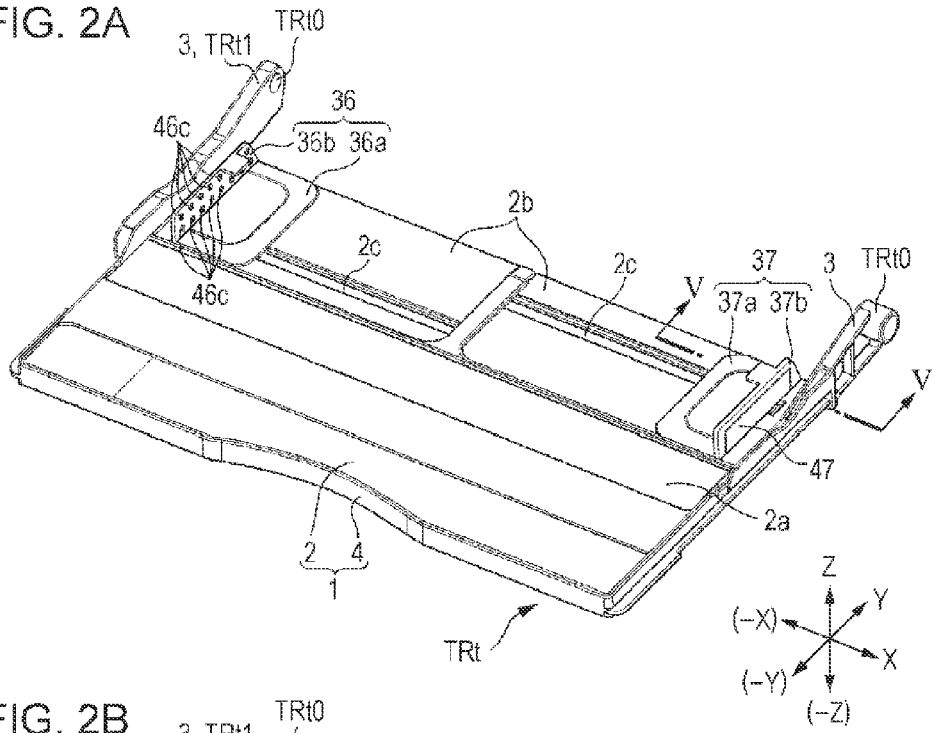
Figure 2B:
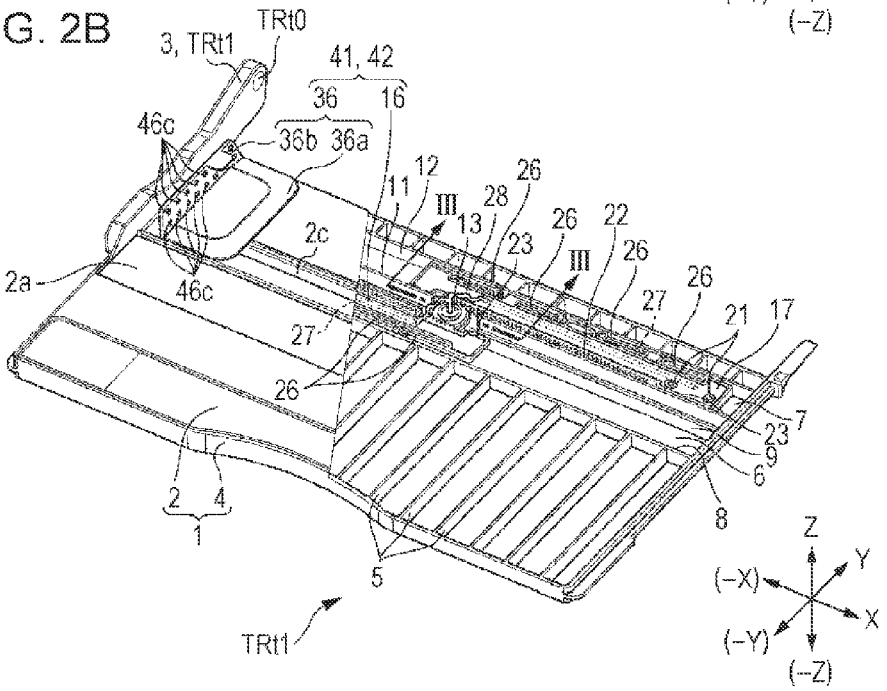

FIGS. 2A and 2B are explanatory diagrams of the manual paper-feed tray according to the first example, in which FIG. 2A is a perspective view, and FIG. 2B is a partial sectional view of FIG. 2A. In FIGS. 2A and 2B, the manual paper-feed tray TRt according to the first example includes a tray body 1, which is an example of a container portion. The tray body 1 includes a holding plate 2 provided at the upper side, which is an example of a holding member. The holding plate 2 has a holding surface 2*a* at the top, which holds the sheets S to be fed. A pair of front and back recesses 2*b*, which are recessed from the holding surface 2*a* and are examples of a jogger accommodating portion, are formed on the right side of the holding surface 2*a*. Each recess 2*b* has a slit 2*c* extending in the front-rear direction, which is an example of a connecting-member passing portion. The slits 2*c* are provided through the holding plate 2 in the top-bottom direction.

Supported portions 3 extending rightward are provided at both the front and back ends on the right side of the holding plate 2. The center of rotation TRt0 is provided at the right ends of the supported portions 3. Thus, the manual paper-feed tray TRt is supported so as to be rotatable about the center of rotation TRt0 of the supported portions 3 relative to the printer unit U1. Furthermore, in the first example, the supported portions 3 constitute the portion, TRt1, of the manual paper-feed tray TRt. A lower plate portion 4, which is an example of a jogger support member, is supported by the holding plate 2, below the holding plate 2. In FIG. 2B, multiple reinforcing ribs 5 extending in the left-right direction, which are examples of reinforcing portions, are formed on the left side of the lower plate portion 4. On the right side of the lower plate portion 4, a pair of left and right rack accommodating portions 6 and 7 in the shape of an elongated recess and extending in the front-rear direction, which are examples of moving member accommodating portions, are formed below the recesses 2*b*, at positions corresponding to the slits 2*c*.

A left guide wall 8 extending in the front-rear direction, which is an example of a guide portion, is formed on the left side of the left accommodating portion 6. A left contact wall 9 extending in the front-rear direction, which is an example of a second guide portion, is formed on the right side of the left accommodating portion 6. A right guide wall 11 extending in the front-rear direction, which is an example of the guide portion, is formed on the right side of the right accommodating portion 7. A right contact wall 12 extending in the front-rear direction, which is an example of the second guide portion, is formed on the left side of the right accommodating portion 7. A pinion gear 13, which is an example of a gear, is disposed on the lower plate portion 4, at a position between the contact walls 9 and 12 and at the center in the front-rear direction. The pinion gear 13 according to the first example has such an outside diameter that the left and right portions of the outer edge thereof pass through the contact walls 9 and 12 and are in the rack accommodating portions 6 and 7.

Figure 3:
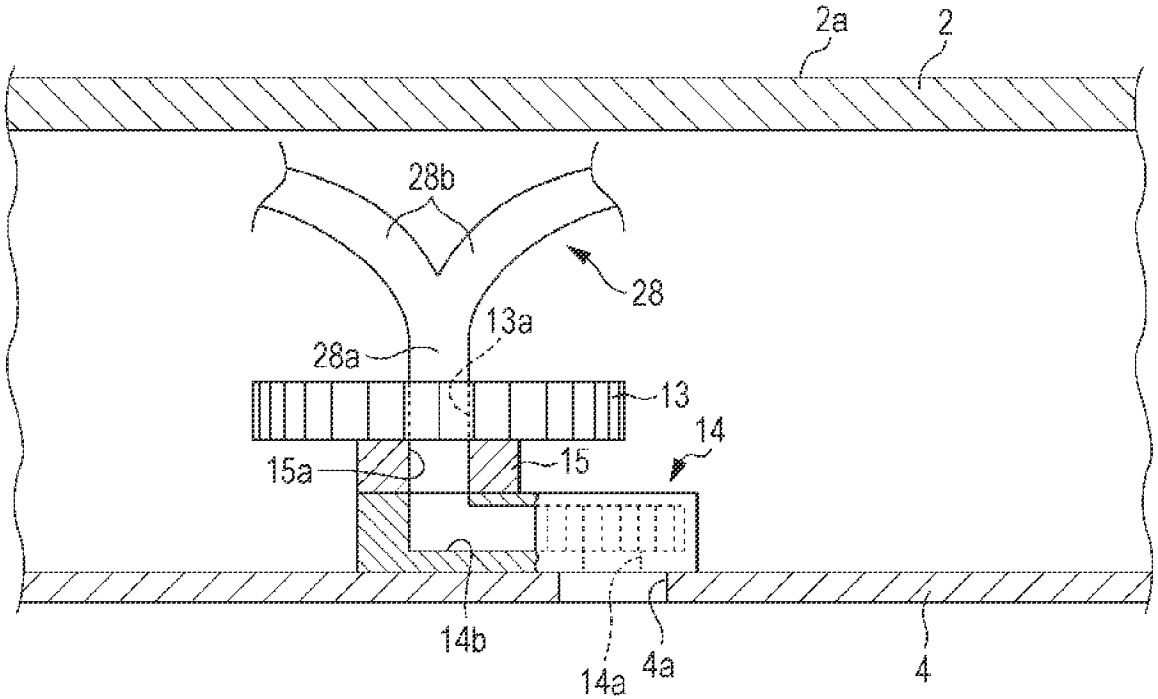
FIG. 3 is an explanatory diagram of the relevant part of a gear portion according to the first example, showing a section taken along line III-III in FIG. 2.

FIG. 3 is an explanatory diagram of the relevant part of the gear portion according to the first example, showing a section taken along line III-III in FIG. 2. In FIG. 3, the pinion gear 13 has a through path 13*a* that extends through the pinion gear 13 in the axial direction. A blower 14, which is an example of a blowing device, is disposed below the pinion gear 13. The blower 14 is secured to the top surface of the lower plate portion 4. The blower 14 has an inlet port 14*a* and an exhaust port 14*b*. The lower plate portion 4 according to the first example has an intake port 4*a*, which is an example of a gas-passing portion, at a position corresponding to the inlet port 14*a*. A shaft 15, which is an example of a gear support portion, is supported on the top surface of the blower 14. The shaft 15 supports the pinion gear 13 in a manner allowing rotation. The shaft 15 has a connecting path 15*a* extending through the shaft 15 in the top-bottom direction. The connecting path 15*a* connects the exhaust port 14*b* in the blower 14 and the through path 13*a* in the pinion gear 13.

Figure 4:
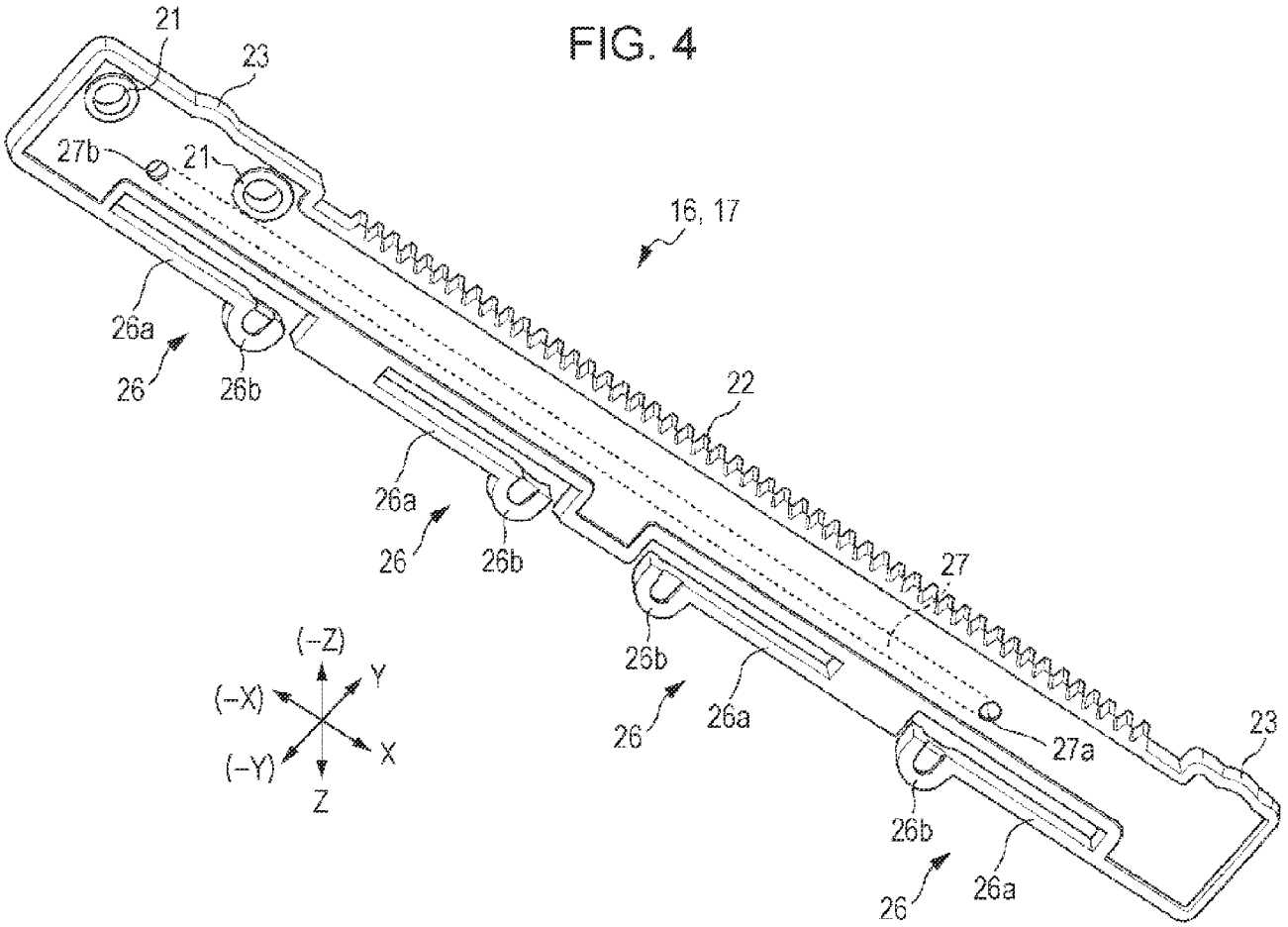
FIG. 4 is an explanatory diagram of a moving member according to the first example.

FIG. 4 is an explanatory diagram of a moving member according to the first example. A left rack 16 (FIG. 4), which is an example of a first guided member, is disposed in the left rack accommodating portion 6 (FIG. 2B). Furthermore, a right rack 17, which is an example of a second guided member, is disposed in the right rack accommodating portion 7. The racks 16 and 17, which are examples of the guided member, have the same configuration and are disposed symmetrically with respect to the pinion gear 13. Hence, in the description below, only the left rack 16 will be described in detail, and the description of the right rack 17 will be omitted. In FIG. 4, the rack 16 according to the first example is formed in the shape of a plate extending in the front-rear direction. The rack 16 has screw through-holes 21 extending in the top-bottom direction, which are examples of a connecting portion, in the trailing end portion.

A gear portion 22, which is an example of a first meshing portion, is formed on the right side surface of the rack 16 so as to extend from the front portion to the rear portion of the rack 16. The gear portion 22 meshes with the pinion gear 13. A pair of projections 23 are formed on the right side surface of the rack 16, on the front side and rear side of the gear portion 22. The projections 23 according to the first example are semicircular protruding plates. The projections 23 are formed so as to be in contact with the contact wall 9.

Multiple spring arms 26, which are examples of a contact member, are formed on the left side surface of the rack 16. The spring arms 26 according to the first example are disposed symmetrically with respect to the center in the front-rear direction. The spring arms 26 according to the first example each have a plate spring portion 26*a* extending in the front-rear direction. The plate spring portion 26*a* has a projection 26*b*, which is an example of a contact portion, at a free end thereof. The projections 26*b* according to the first example are semicircular protruding plates. The projections 26*b* are configured to be able to come into contact with the guide wall 8. When the projections 26*b* come into contact with the guide wall 8, the plate spring portions 26*a* are elastically deformed. Thus, the projections 26*b* press the guide wall 8 with an elastic force generated by the elastic deformation of the spring arms 26.

Thus, the racks 16 and 17 according to the first example are supported so as to be movable in the front-rear direction along the accommodating portions 6 and 7, with the projections 26*b* being in contact with the guide walls 8 and 11 and the projections 23 being in contact with the contact walls 9 and 12. At this time, the gear portions 22 of the racks 16 and 17 mesh with the pinion gear 13, and the amount of front-rear movement of the left rack 16 equals to that of the right rack 17. That is, moving one of the racks 16 and 17 forward or backward causes the other rack to move backward or forward via the gear portion 22 and the pinion gear 13. In the first example, the positions where the projections 23 are in contact with the contact walls 9 and 12 are located on the outer side in the front-rear direction with respect to the positions where the projections 26*b* are in contact with the guide walls 8 and 11.

Figure 5:
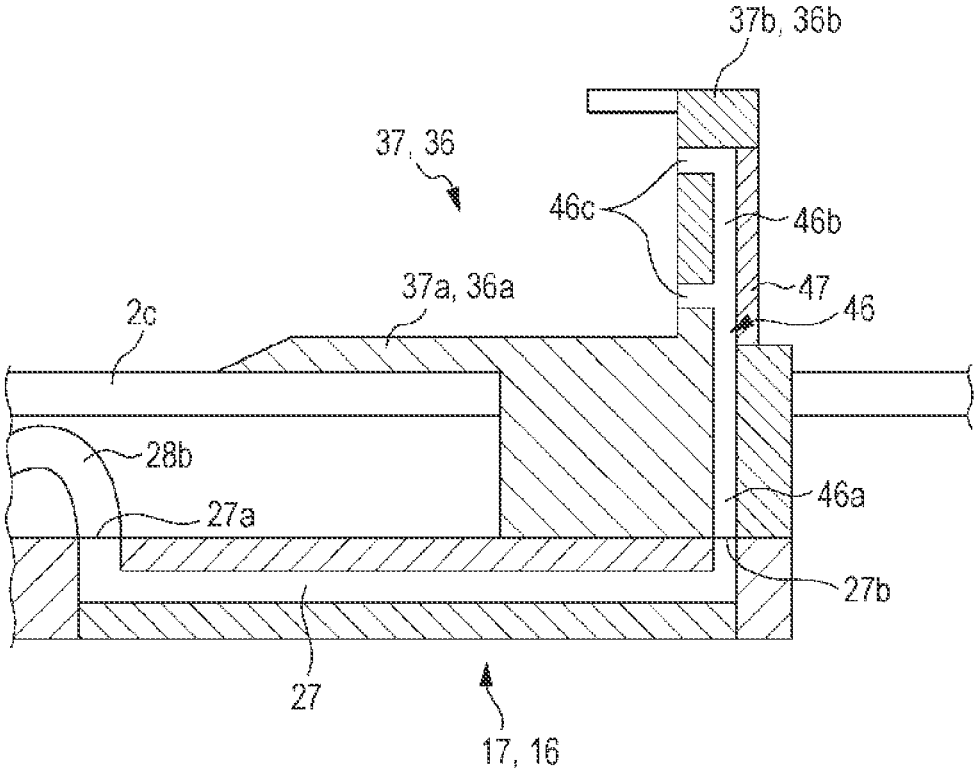
FIG. 5 is an explanatory diagram of the relevant part of a flow path according to the first example, showing a section taken along line V-V in FIG. 2A.

FIG. 5 is an explanatory diagram of the relevant part of a flow path according to the first example, showing a section taken along line V-V in FIG. 2A. In FIGS. 4 and 5, the racks 16 and 17 according to the first example each have a rack flow path 27, which is an example of a flow path, formed inside thereof. The rack flow path 27 according to the first example extends in the front-rear direction. An inflow port 27*a* is formed on the pinion gear 13 side of the rack flow path 27. An outflow port 27*b* is formed on the outer side of the rack flow path 27 in the front-rear direction. In FIG. 2B, the inflow ports 27*a* are connected to the through path 13*a* via a tube 28, which is an example of a connecting member. In FIGS. 2B and 3, the tube 28 according to the first example has an inflow portion 28*a* connected to the through-hole 13*a* and outflow portions 28*b* continuous with the inflow portion 28*a* and diverging from each other. The outflow portions 28*b* are connected to the inflow ports 27*a* in the racks 16 and 17. The tube 28 according to the first example is flexible. The outflow portions 28*b* are long enough to keep the through path 13*a* and the inflow ports 27*a* connected to each other even if the racks 16 and 17 have moved to the maximum moving range. Thus, as shown in FIG. 2B, when the racks 16 and 17 are located at positions within the maximum moving range, the tube 28 is slack.

In FIGS. 2A, 2B, 4, and 5, the left rack 16 supports a rear side guide 36, which is an example of a first jogger. Furthermore, the right rack 17 supports a front side guide 37, which is an example of a second jogger. The side guides 36 and 37, which are examples of the jogger, have bottom plate portions 36*a* and 37*a* extending along the holding surface 2*a*. Jogger walls 36*b* and 37*b* extending upward, which are examples of a jogger member body, are formed at the outer ends of the bottom plates 36*a* and 37*a* in the front-rear direction. The side guides 36 and 37 are fastened to the racks 16 and 17 by screws (not shown) that pass through screw through-holes 21 and slits 2*c* and are fastened to the bottom plates 36*a* and 37*a*. Thus, the side guides 36 and 37 move in the front-rear direction along with the racks 16 and 17. The rear side guide 36 and the left rack 16 constitute a rear guide unit 41, which is an example of a first moving member according to the first example. The front side guide 37 and the right rack 17 constitute a front guide unit 42, which is an example of a second moving member according to the first example. The rear guide unit 41 and the front guide unit 42 form the guide units (41+42), which are examples of the moving member according to the first example.

Figure 6:
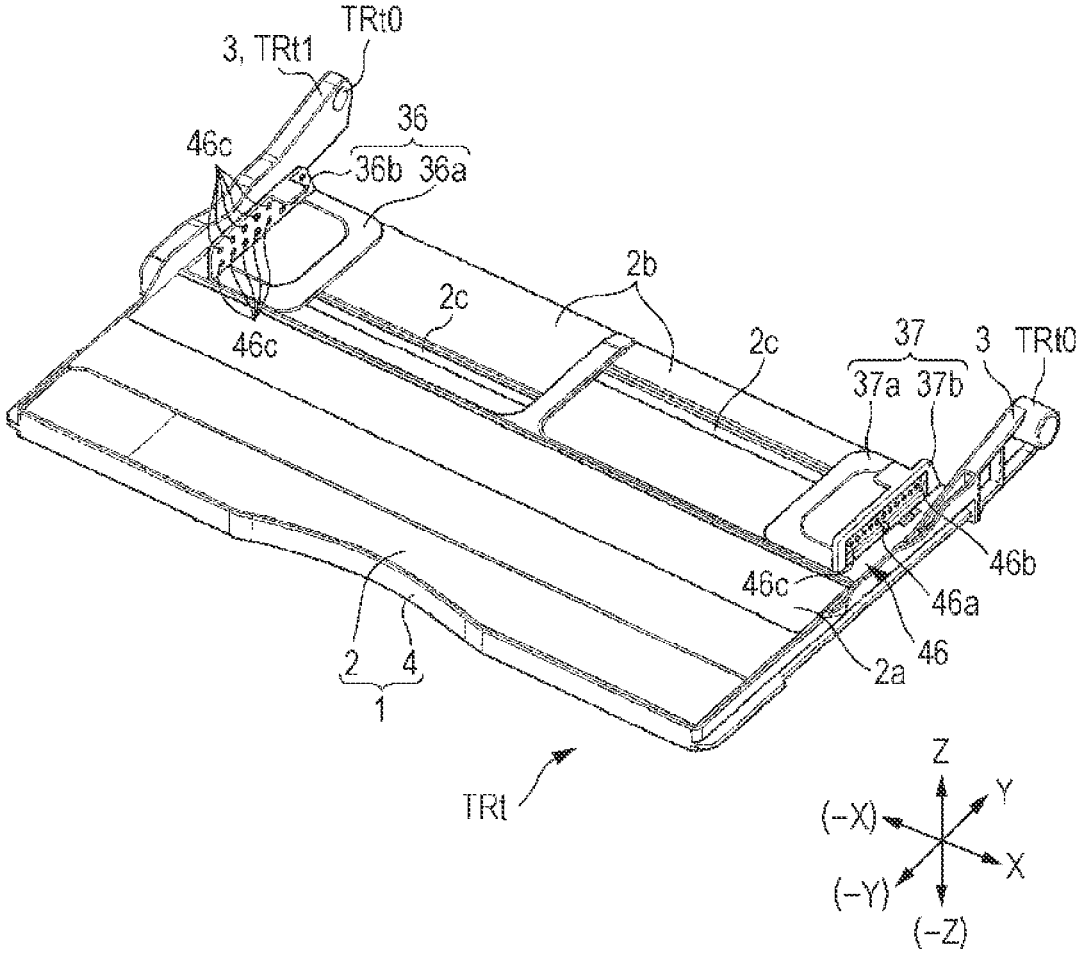
FIG. 6 is an explanatory diagram corresponding to FIG. 2A, showing a state in which a cover of a front side guide is removed.

FIG. 6 is an explanatory diagram corresponding to FIG. 2A, showing a state in which a cover of the front side guide is removed. In FIGS. 5 and 6, blower portions 46, which are examples of the flow path, are formed inside the side guides 36 and 37 according to the first example. The outer side portions of the blower portions 46 in the front-rear direction are covered by covers 47. The blower portions 46 include connecting portions 46*a* extending from the lower ends of the side guides 36 and 37 to the upper portions of the jogger walls 36*b* and 37*b*. Blower chambers 46*b* extending in the front-rear direction are formed at the upper ends of the connecting portions 46*a*. The blower chambers 46*b* have multiple blower nozzles 46*c* provided in the jogger walls 36*b* and 37*b* toward the inner side in the front-rear direction. Thus, in the manual paper-feed tray TRt according to the first example, the connecting path 15*a*, the through path 13*a*, the tube 28, the rack flow paths 27, and the blower portions 46 form an air flow path (13*a*+15*a*+27+46).

Function of Manual Paper-Feed Tray According to First Example

In the thus-configured manual paper-feed tray TRt according to the first example, when sheets S are to be fed from the manual paper-feed tray TRt, the sheets S are placed on the holding surface 2*a*. Due to an operator moving the side guides 36 and 37 to bring the inner surfaces of the jogger walls 36*b* and 37*b* into contact with the side surfaces of the sheets S, the side edges of the sheets S are aligned. When the sheets S are fed in this state, the sheets S are fed by being guided by the side guides 36 and 37. At this time, because of the elastic force exerted by the spring arms 26, the positions of the side guides 36 and 37 are maintained. That is, compared with the configuration in which no spring arms 26 are provided, the side guides 36 and 37 are less likely to move during paper feeding, and thus, the sheets S are more likely to be precisely guided.

Furthermore, in the manual paper-feed tray TRt according to the first example, when the sheets S are fed, the blower 14 is activated. When the blower 14 is activated, gas is ejected from the blower nozzles 46*c* through the flow path (13*a*+15*a*+27+46). The gas ejected from the blower nozzles 46*c* is ejected at the side surface of the sheets S. The gas ejected at the sheets S flows between the sheets S to separate the sheets S. Thus, compared with the configuration in which gas is not ejected, feeding the sheets S in a stacked state is suppressed. Accordingly, paper jam and printing defect are suppressed.

In the manual paper-feed tray TRt according to the first example, the blower 14 is supported by the tray body 1, and the flow path (13*a*+15*a*+27+46) is formed in the racks 16 and 17 and the side guides 36 and 37. Thus, compared with the configuration in which the blower 14 is supported by the side guides 36 and 37, the side guides 36 and 37 are reduced in size and weight. Thus, decrease in operability of the side guides 36 and 37 is suppressed.

Furthermore, if the blower 14 is fixed and the side guides 36 and 37 are movable, the distance between the side guides 36 and 37 and the blower 14 changes according to the size of the sheets S. Thus, the amount of air ejected from the blower 14 changes according to the sheets S. In such a case, the ability to separate the sheets S may vary according to the size of the sheets S. In the manual paper-feed tray TRt according to the first example, the side guides 36 and 37 have the blower nozzles 46*c*, and the distance between the blower nozzles 46*c* and the edges of the sheets S does not change even if the size of the sheets S changes. Therefore, the ability to separate the sheets S is more likely to be stabilized.

Furthermore, in the manual paper-feed tray TRt according to the first example, the air from one blower, 14, is sent to the side guides 36 and 37. Thus, compared with the configuration in which the blower 14 is provided for each of the side guides 36 and 37, the number of components is reduced. Thus, compared with the configuration in which the blower 14 is provided for each of the side guides 36 and 37, the fabrication cost is reduced. In addition, in the first example, the blower 14 is accommodated in the tray body 1. Thus, compared with the configuration in which the blower 14 is supported by the outer surface of the manual paper-feed tray TRt, deterioration of the appearance of the manual paper-feed tray TRt is suppressed.

Second Example

Figure 7:
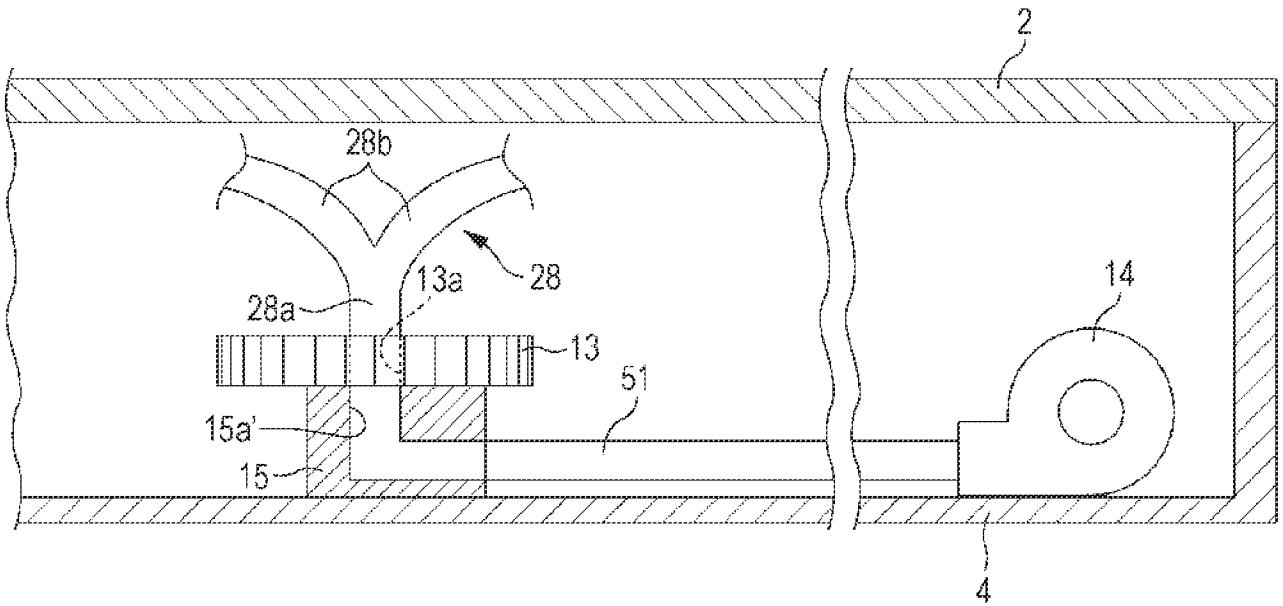
FIG. 7 is an explanatory diagram of the relevant part of a gear portion according to a second example, which corresponds to FIG. 3 showing the same part according to the first example.

FIG. 7 is an explanatory diagram of the relevant part of a gear portion according to a second example, which corresponds to FIG. 3 showing the same part according to the first example. In this description of the second example, the components corresponding to those in the first example will be denoted by the same reference numerals, and the detailed descriptions thereof will be omitted. The second example has the same configuration as the first example described above, except for the following configurations. In FIG. 7, in the manual paper-feed tray TRt according to the second example, the blower 14 is supported by the rear end portion of the tray body 1, not below the pinion gear 13. Furthermore, the exhaust port 14*b* of the blower 14 and a connecting path 15*a*' of the shaft 15 are connected by a tube 51, which is an example of the connecting member.

Function of Manual Paper-Feed Tray According to Second Example

Also in the manual paper-feed tray TRt according to the second example, which has the above-described configuration, similarly to the first example, the gas from the blower 14 is ejected at the sheets S from the side guides 36 and 37. Thus, similarly to the first example, the sheets S are separated by the gas ejected at the sheets S. Furthermore, in the second example, it is possible to change the position of the blower 14 via the tube 51. Thus, the positional flexibility of the blower 14 increases.

Modification Examples

Although the examples of the present invention have been described in detail, the present invention is not limited to these examples, and it may be variously modified within the scope of the spirit of the present invention described in the Claims. Modification examples (H01) to (H07) of the present invention will be described below. (H01) Although the copying machine U has been described as an example of the image forming apparatus in the above-described examples, the image forming apparatus is not limited thereto. For example, the present invention may be applied to printers, facsimiles, and multifunction devices having these functions, which are examples of the image forming apparatus. Furthermore, the present invention may be applied not only to monochrome image forming apparatuses, but also to color image forming apparatuses. Moreover, the present invention may be applied not only to a configuration in which the transfer belt B, which supports the sheet S on the surface thereof, is used, but also to a configuration in which an intermediate transfer belt is used.

(H02) Although the configuration in which the flow paths 13*a* and 15*a* passing through the center of the pinion gear 13 are formed has been described in the above-described examples, the present invention is not limited thereto, and it is possible to employ a configuration in which the blower 14 and the inflow ports 27*a* in the racks 16 and 17 are directly connected. (H03) Although the blower has been described as an example of the blowing device in the above-described examples, the blowing device is not limited thereto. For example, any blowing device, such as a fan or a pump, may be used. (H04) Although the number of the blowers 14 has been assumed to be one in the above-described examples, the number of the blowers 14 is not limited thereto. The blower 14 may be provided for each of the side guides 36 and 37. Furthermore, it is possible that a high-power fan and a low-power fan are installed, and the fans are switched depending on the type of the sheets S and the environment, such as humidity. For example, it is possible to supply the gas from the high-power fan when the sheets S are difficult to separate because coated sheets are used or because printing is performed under a low-temperature, low-humidity environment.

(H05) Although the configuration in which gas is ejected from the front and rear side guides 36 and 37 has been described in the above-described examples, the configuration is not limited thereto. For example, a configuration in which gas is ejected from only one of them is also possible. In addition, a configuration in which gas is ejected at the jogger disposed on the rear side with respect to the sheet-transport direction (which is called "an end guide") is also possible. (H06) Although the manual paper-feed tray TRt, which is an example of the sheet container, has been described in the above-described examples, the sheet container is not limited thereto. For example, the present invention may be applied to the document tray TG1 and the paper-feed trays TR1 to TR4.

(H07) Although the configuration in which the blower 14 is disposed below the pinion gear 13 in the above-described examples, the present invention is not limited thereto. For example, a configuration in which the blower 14 is disposed above the pinion gear 13 is also possible.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A media container comprising:

a holding portion having a holding surface on which media are held;

a jogger that comes into contact with edges of the media held on the holding surface to align the edges of the media, the jogger having a blower nozzle from which gas is ejected at the edges of the media held on the holding surface;

a guided rack member that is supported by the jogger and is supported by the holding portion so as to be movable toward and away from the edges of the media;

a blowing device that is supported by the holding portion and ejects the gas at the media;

a flow path that is located inside the guided rack member and connects the blowing device and the blower nozzle, through which the gas from the blowing device flows; and a gear, wherein the jogger includes a first jogger that aligns first edges of the media and a second jogger that aligns second edges of the media, wherein the guided rack member includes a first guided rack member supported by the first jogger and a second guided rack member supported by the second jogger, the first guided rack member having a first meshing portion and the second guided rack member having a second meshing portion, the first meshing portion and the second meshing portion meshing with the gear, and wherein the flow path is located inside the first guided rack member, the second guided rack member, and the gear.

2. The media container according to claim 1, wherein the blowing device is supported below the holding portion.

3. The media container according to claim 1, further comprising a connecting member that connects the blowing device and the flow path located inside the gear, wherein the blowing device is supported at an end of the holding portion corresponding to the first edges of the media.

4. An image forming apparatus comprising:

the media container in which a medium is stored, according to claim 1; and a recording unit that records an image on the medium fed from the container.

5. An image forming apparatus comprising:

the media container in which a medium is stored, according to claim 3; and a recording unit that records an image on the medium fed from the container.

6. The media container according to claim 1, wherein the guided rack member is non-elastic.

7. The media container according to claim 1, wherein the guided rack member is plate-shaped.

8. A media container comprising:

a holding portion having a holding surface on which media are held;

a jogger that comes into contact with edges of the media held on the holding surface to align the edges of the media, the jogger having a blower nozzle from which gas is ejected at the edges of the media held on the holding surface;

a guided member that is supported by the jogger and is supported by the holding portion so as to be movable toward and away from the edges of the media;

a blowing device that is supported by the holding portion and ejects the gas at the media;

a flow path that is located inside the guided member and connects the blowing device and the blower nozzle, through which the gas from the blowing device flows; and a gear, wherein the jogger includes a first jogger that aligns first edges of the media and a second jogger that aligns second edges of the media, wherein the guided member includes a first guided member supported by the first jogger and a second guided member supported by the second jogger, the first guided member having a first meshing portion and the second guided member having a second meshing portion, the first meshing portion and the second meshing portion meshing with the gear, and wherein the flow path is located inside the first guided member, the second guided member, and the gear.

9. A media container comprising:

a holding portion having a holding surface on which media are held;

a jogger that comes into contact with edges of the media held on the holding surface to align the edges of the media, the jogger having a blower nozzle from which gas is ejected at the edges of the media held on the holding surface;

a guided rack member that is supported by the jogger and is supported by the holding portion so as to be movable toward and away from the edges of the media;

a blowing device that is supported by the holding portion and ejects the gas at the media; and a flow path that is located inside the guided rack member and connects the blowing device and the blower nozzle, through which the gas from the blowing device flows, wherein the guided rack member comprises a meshing portion configured to mesh with a gear.

* * * * *